US008529233B2

(12) United States Patent
Spinnler

(10) Patent No.: US 8,529,233 B2
(45) Date of Patent: Sep. 10, 2013

(54) DISPLACEMENT MACHINE WITH IMPROVED SUPPORT

(75) Inventor: Fritz Spinnler, Mellingen (CH)

(73) Assignee: Spinnler Engineering, Mellingen (CH)

( * ) Notice: Subject to any disclaimer, the term of this patent is extended or adjusted under 35 U.S.C. 154(b) by 717 days.

(21) Appl. No.: 12/688,142

(22) Filed: Jan. 15, 2010

(65) Prior Publication Data

US 2010/0183466 A1 Jul. 22, 2010

Related U.S. Application Data

(63) Continuation-in-part of application No. PCT/CH2008/000310, filed on Jul. 10, 2008.

(30) Foreign Application Priority Data

Jul. 26, 2007 (CH) ..... 1196/07

(51) Int. Cl.
*F03C 2/00* (2006.01)
*F03C 4/00* (2006.01)
*F04C 2/00* (2006.01)

(52) U.S. Cl.
USPC ..... 418/60; 418/55.1; 418/55.4; 418/55.6; 418/151

(58) Field of Classification Search
USPC ..... 418/55.1–55.6, 57, 151, 60, 11
See application file for complete search history.

(56) References Cited

U.S. PATENT DOCUMENTS

| | | | | | |
|---|---|---|---|---|---|
| 4,526,521 | A | * | 7/1985 | Siidbeck et al. | 418/55.3 |
| 4,715,797 | A | * | 12/1987 | Guttinger | 418/60 |
| 5,033,945 | A | | 7/1991 | Kolb | |
| 5,040,958 | A | * | 8/1991 | Arata et al. | 418/151 |
| 6,132,193 | A | * | 10/2000 | Kolb et al. | 418/55.3 |
| 6,579,080 | B1 | * | 6/2003 | Spinnler | 418/60 |

FOREIGN PATENT DOCUMENTS

| | | | |
|---|---|---|---|
| DE | 32 31 756 | A1 | 3/1984 |
| DE | 33 13 000 | A1 | 10/1984 |
| EP | 0 201 774 | | 11/1986 |
| EP | 0 371 305 | A | 6/1990 |
| EP | 0 557 598 | A | 9/1993 |
| EP | 0807 759 | | 11/1997 |
| JP | 61 215479 | A | 9/1986 |
| JP | 05 296168 | A | 11/1993 |

* cited by examiner

*Primary Examiner* — Theresa Trieu
(74) *Attorney, Agent, or Firm* — Henry M. Feiereisen LLC

(57) ABSTRACT

A displacement machine of spiral-type construction for a compressible medium includes a displacement body having a carrier disc and helical blades extending out from both sides of the carrier disc. The carrier disc has a hub which is supported by a hub bearing on an eccentric disc which is part of a driven drive shaft. The drive shaft is supported inside a housing by a first bearing and a second bearing. These bearings are arranged in receptacles which fully project into the feed chambers of the housing so that the bearings are positioned in close proximity to the eccentric disc.

10 Claims, 2 Drawing Sheets

DISPLACEMENT MACHINE WITH IMPROVED SUPPORT

CROSS-REFERENCES TO RELATED APPLICATIONS

This application is a continuation-in-part of prior filed copending PCT International application no. PCT/CH2008/000310, filed Jul. 10, 2008, which designated the United States and has been published as International Publication No. WO 2009/012606 and on which priority is claimed under 35 U.S.C. §120 and which claims the priority of Swiss Patent Application, Serial No. 1196/07, filed Jul. 26, 2007, pursuant to 35 U.S.C. 119(a)-(d), the contents of which are incorporated herein by reference in its entirety as if fully set forth herein.

BACKGROUND OF THE INVENTION

The present invention relates, in general, to a displacement machine for compressible media.

The following discussion of related art is provided to assist the reader in understanding the advantages of the invention, and is not to be construed as an admission that this related art is prior art to this invention.

Displacement machines of this type are known, for example from German patent document DE-A-33 13 000 and European patent documents EP 0 557 598 A and EP-A-0 371 305, and include a housing which is comprised of two housing portions and accommodates a displacement body. The displacement body is supported by a bearing upon an eccentric disc. A drive shaft, supported in the housing by two bearings which oppose one another in relation to the eccentric disc, extends through a housing wall on its drive side to supports on its drive-side end a drive disc which is connected with a drive. Counterweights are connected with the drive shaft and accommodated in lateral housing walls in close proximity of the eccentric disc in an attempt to prevent a bending of the drive shaft during operation, in particular when high rotation speeds are involved.

During operation of a displacement machine, several, substantially crescent-shaped work spaces are enclosed in the displacement or feed chamber between the spiral-shaped displacement body and the two circumferential walls and move from the inlet through the feed chamber to the outlet, with their volume steadily decreasing and the pressure of the work fluid increasing accordingly. A compressor operating in accordance with this principle is characterized by a low-pulsating transport of the gaseous work fluid, e.g. air, and could thus be utilized advantageously i.a. for charging purposes in internal combustion engines.

It would be desirable and advantageous to provide an improved displacement machine to obviate prior art shortcomings and to keep a bending of the drive shaft during operation to a minimum, even when operating the displacement machine at high rotation speeds.

SUMMARY OF THE INVENTION

According to one aspect of the present invention, a displacement machine for a compressible medium includes a fixed housing comprised of two housing portions and having at least one spiral-shaped feed chamber, each housing portion being provided with a bearing receptacle which projects into the feed chamber, a displacement body associated to the feed chamber and including a carrier disc and helical blades extending out from both sides of the carrier disc, a bearing unit supporting the displacement body on the eccentric disc, a drive shaft provided with an eccentric disc and rotatably supported in the housing on both sides of the eccentric disc by a first bearing and a second bearing, respectively, which are supported by the bearing receptacles, respectively, with the drive shaft sized to extend on a drive side through a wall of the housing and having a drive-side end, with the first and second bearings defined by centers which lie in a vertical plane within the feed chamber, first and second counterweights arranged on the drive shaft on both sides of the eccentric disc and disposed between the eccentric disc and the first and second bearings, respectively, and a drive supported by the drive-side end of the drive shaft.

According to another advantageous feature of the present invention, each counterweight may include a massive part disposed at a distance to a rotation axis of the drive shaft, and a mounting part coupled with the drive shaft in fixed rotative engagement and connected to the massive part, wherein the mounting part has in a direction of the rotation axis of the drive shaft an axial dimension which is smaller than an axial dimension of the massive part. Suitably, the axial dimension of the massive part is sized so as to overlap, at least in part, with both sides a hub of the carrier disc and the bearing receptacle.

According to another advantageous feature of the present invention, a support part may extend from the housing in a direction of a length axis of the drive shaft and may be traversed by the drive shaft, with a third bearing seated on the drive shaft for support in the support part.

The slight distance between the first and second bearings as a result of orienting the centers of both bearings in a vertical plane within the respective feed chamber enables to more freely select the distance between the drive and the one bearing inside the housing that is positioned on the side of the drive in relation to the eccentric disc. This can even be further enhanced by the presence of a further bearing to support the drive shaft on its drive-side end that projects out from the housing

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
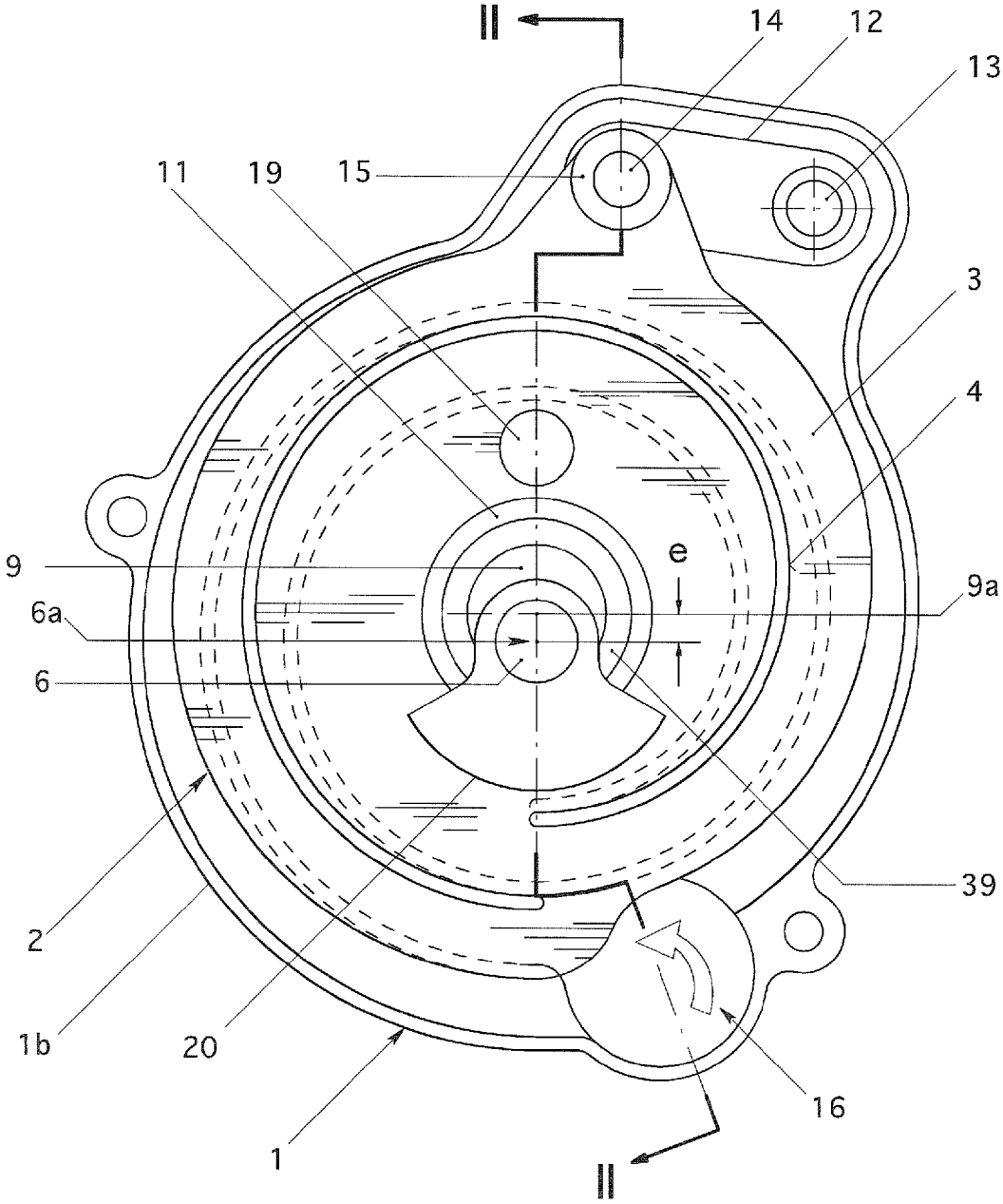
FIG. 1 a front view of the drive-side housing portion of a displacement machine.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 2:
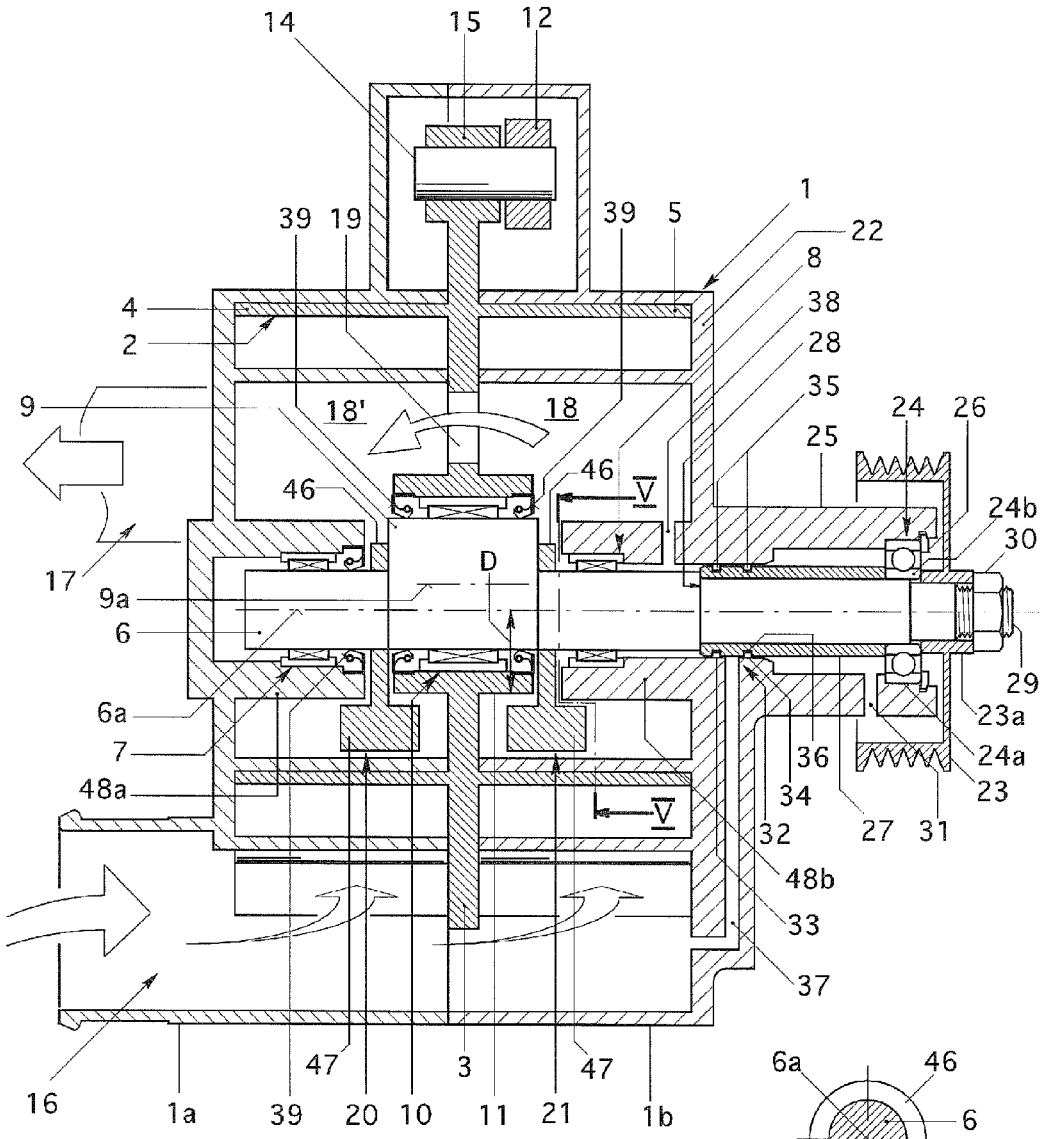
FIG. 2 a longitudinal section of the displacement machine according to FIG. 1, taken along the line III-III in FIG. 1.

Turning now to the drawing, and in particular to FIGS. 1 and 2, there are shown a front view and a sectional view, respectively, of a displacement machine including a housing 1 comprised of two housing portions 1*a*, 1*b* for support of a displacement body 2. Both housing portions 1*a*, 1*b* are bolted to one another in a manner not shown in greater detail. The one housing portion 1*a* (FIG. 2) is not shown in the illustration of FIG. 1.

The displacement body 2 has a carrier disc 3 which carries on each side a spiral-shaped displacement element 4, 5. The displacement elements 4, 5 are configured as bars projecting from the carrier disc 3 and constructed in the form of helical blades. Provided for support of the carrier disc 3 is a drive shaft 6 defined by a rotation axis 6*a*. The drive shaft 6 is supported in the housing portions 1*a*, 1*b* by a first bearing 7 and a second bearing 8 and has an eccentric disc 9 which is defined by a symmetry axis 9*a*. The distance between the rotation axis 6*a* of the drive shaft 6 and the symmetry axis 9*a* of the eccentric disc 9 (eccentricity) is designated in FIG. 1 with "e".

The carrier disc 3 has a hub 11 which is supported on the eccentric disc 9 by a hub bearing 10, e.g. a rolling bearing. The carrier disc 3 and thus the displacement body 2 is driven by the drive shaft 6 and the eccentric disc 9. The driving force is hereby transmitted via the hub bearing 10 onto the hub 11 of the carrier disc 3. The displacement body 2 is guided via a rocker 12 which is rotatably supported on one end upon a shaft 13 (FIG. 1). The other end of the rocker 12 supports a bolt 14 which is rotatably supported in an eye 15 of the carrier disc 3.

The housing 1 has an inlet 16 and an outlet 17 for a transport medium, e.g. air, as well as two feed chambers 18, 18'. The carrier disc 3 includes an opening 19 (or several openings) for allowing the transport medium to flow from the feed chamber 18 into the transport chamber 18'.

To compensate the inertia forces caused during eccentric drive of the displacement body 2, two counterweights 20, 21 are arranged on the drive shaft 6 in as close proximity as possible to the eccentric disc 9 so as to keep a bending of the drive shaft 6 during operation as little as possible or to prevent it altogether. The distance between the bearings 7 and 8 and the neighboring counterweights 20 and 21, respectively, and thus also the distance between the bearings 7, 8 and the eccentric disc 9 is also kept as small as possible so as to further contribute to keep to a minimum or even prevent a bending of the drive shaft 6 during operation.

As best shown in FIG. 2, the housing portions 1*a*, 1*b* are configured to have bearing receptacles 48*a*, 48*b* which receive the bearings 7, 8 and sized to fully project inside the housing interior into the feed chambers 18' and 18, respectively, with the centers of the bearings 7, 8 lying in a vertical plane within the respective feed chamber 18, 18'. As a result, the distance between the bearings 7, 8 can be kept significantly smaller than is the case in conventional designs which having bearing receptacles positioned either in the plane of the housing walls or even outside thereof.

The drive shaft 6 extends in relation to the eccentric disc 9 on the side of the bearing 8 through the wall 22 of the housing portion 1 b and carries a drive disc 23 on its end projecting out of the housing 1. The drive disc 23 arranged on the outer side of the housing 1 is connected with a not shown drive in a manner not shown in greater detail, e.g. by means of a driving belt.

In the illustrated example, the drive shaft 6 is supported on its drive-side end, which carries the drive disc 23, by a third bearing 24, e.g. a rolling bearing such as a ball bearing. The bearing 24 sits in the area of the drive disc 23 upon the drive shaft 6 advantageously approximately in the mid-plane of the drive disc 23 in order to minimize or eliminate the influence of the clamping force of a driving belt (not shown), guided about the drive disc 23, upon the bending of the drive shaft 6. The bearing 24 is held in a support part 25 which projects from the housing 1 in the direction of the rotation axis 6*a* of the drive shaft 6 and is formed in one piece with the housing portion 1*b* in the illustrated exemplified embodiment. Thus, the bearing 24 is connected to the housing 1 in a radially rigid manner.

The support part 25 may, however, also be configured as a component which is separate from the housing 1 and mounted to the housing 1, so long a radially rigid construction with the housing 1 is realized.

The bearing 24 is configured in the illustrated exemplified embodiment as axial bearing to axially align the drive shaft 6 in the housing 1. The outer ring 24*a* of the bearing 24 is supported in axial direction in the support part 25 and secured by a locking ring 26. The inner ring 24*b* of the bearing 24 is positioned between a spacer sleeve 27, which is pushed onto the drive shaft 6 and rests upon a shoulder 28 formed on the drive shaft 6, and the hub 23*a* of the drive disc 23. The spacer sleeve 27, the inner ring 24*b* of the bearing 24, and the hub 23*a* of the drive disc 23 are braced against the shoulder 28 by means of a screw nut 30 screwed onto a thread 29 provided at the end of the drive shaft 6.

The bearing 24 is greased as shown in FIG. 2. To prevent the bearing 24 from drying out during operation, constructive measures are provided to ensure that a same pressure, i.e. the ambient pressure, prevails on both sides of the bearing 24. The support part 25 is formed for this purpose with an opening 31 for connecting the space on the one side of the bearing 24 which faces the spacer sleeve 27 with the environment. As a result, the pressure prevailing in this environment acts on the first side facing the spacer sleeve 27 as well as on the second side of the bearing 24 which second side is in opposite relationship to this first side in axial direction.

According to variation of the illustrated third bearing, which is arranged here in the plane of the drive disc 23, application of an "indirect" third bearing may also be possible, when a magnetic coupling is placed in fixed rotative engagement on the drive-side end of the eccentric shaft. The shaft of the magnetic coupling is then supported via a bearing in the housing of the magnetic coupling. This housing in turn is supported on the housing portion 1*a* of the displacement machine. The shaft is supported only by the two bearings 7, 8 inside the housing 1, while the "third" bearing is part of the coaxial drive shaft which is connected in fixed rotative engagement with the eccentric shaft.

The additional support of the drive shaft 6 on its drive-side end, whether by means of the "direct" or "indirect" third bearing, permits to more freely select the distance between the second bearing 8 and the attachment site of the drive disc 23 on the drive shaft 6 on one hand or the magnetic coupling on the other hand, without accepting the risk of bending the drive shaft 6.

In order to be able to prevent escape of transport medium from the feed chamber 18, 18' during operation to the outside into the environment, a labyrinth seal 32 is arranged in the area of traversal of the drive shaft 6 through the wall 22 of the housing 1. The labyrinth seal 32 includes two throttles 33, 34 arranged behind one another in longitudinal direction of the drive shaft 6. Each throttle 33, 34 has a stationary sealing member 35 which engages in a groove 36 in the spacer sleeve 27 which rotates jointly with the drive shaft 6. The sealing members 35 are advantageously constructed in the form of piston rings and maintained under tension in the support part 25. Porting into the space between the throttles 33, 34 is one end of a connection line 37 having another end which feeds into the inlet 16. The connection line 37 thus connects the inlet 16 with the space between the throttles 33, 34. In other words, a pressure prevails during operation between the throttles 33 and 34 substantially in correspondence with the pressure in the inlet 16 which pressure is lower than the ambient pressure. Transport medium exiting through the first throttle 33 is routed back via the connection line 37 into the inlet 16 and is prevented from escaping to the outside in longitudinal direction of the drive shaft 6.

The bearing 8 for the drive shaft 6 is also greased, whereby constructive measures are taken to ensure that the bearing 8 does not dry out during operation by providing a same pressure on both sides of the bearing 8. This can be realized by subjecting the bearing 8 on the side which confronts the counterweight 21 to the pressure in the feed chamber 18. In order to realize a same pressure on the other side of the bearing 8, a connection line 38 is provided to connect the feed chamber 18 with this other side of the second bearing 8.

The bearing 7 for the drive shaft 6 as well as the hub bearing 10 for the eccentric disc 9 are lubricated in a manner not shown in greater detail with a liquid lubricant, preferably lubricating oil. The bearings 7 and 10 are sealed against the feed chambers 18, 18' by means of ring-shaped sealing elements 39.

Figure 3:
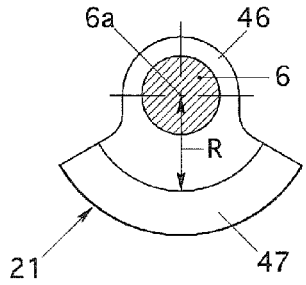
FIG. 3 a section taken along the line in FIG. 2.

As shown in FIGS. 2 and 3, each counterweight 20, 21 is formed by a mounting part 46, connected in fixed rotative engagement with the drive shaft 6, and a massive part 47 which is made in one piece with the mounting part 46. The mounting part 46 of each counterweight 20, 21 has a smallest possible dimension as viewed in axial direction so as to allow placement of the first and second bearings 7 and 8 as closely as possible to the eccentric disc 9. This measure virtually prevents bending of the drive shaft 6 during operation.

The inner radius R of the massive part 47 (FIG. 3) is dimensioned such that it is greater than a radial dimension D (FIG. 2) of the hub 11 of the carrier disc 3 and also greater than an outer diameter of the bearing receptacles 48*a*, 48*b*. As a result, the massive part 47 can be arranged in radial direction outside the hub 11, as shown in FIG. 2. The dimension of the massive part 47 of each counterweight 20, 21 can thus be selected greater, as viewed in axial direction, than the axial dimension of the mounting part 46. In this way, the mounting part 46 can be arranged in close proximity of the eccentric disc 9 and the hub 11 and still maintain a certain freedom as far as configuration of the massive part 47 is concerned.

The size of the mass compensation implemented by the counterweights 20, 21 can be determined through appropriate dimensioning of the massive parts 47. In the present example, the counterweights have a T-shaped cross section, with the transverse beams representing the actual massive parts 47 and configured so as to overlap the hub 11 as well as the bearing receptacles 48*a*, 48*b* with both sides, at least in part.

As a result of the configuration of the counterweights 20, 21, there are no bending moments that act on the mounting parts 46 so that the mounting parts 46 need only transmit the centrifugal force onto the drive shaft 6. Therefore, the mounting parts 46 of the counterweights 20, 21 can be constructed comparably narrow, allowing a disposition of the first and second bearings 7, 8 in close proximity to one another. In addition, the distance between the gravity centers of the counterweights 20, 21 can also be made comparably small. In other words, a bending of the drive shaft 6 during operation of the displacement machine can be kept to a minimum, thereby positively affecting radial plays between the orbiting displacement body 2 and the stationary spiral-shaped feed chambers 18, 18' in the housing 1.

The displacement machines described above and shown in the figures are suitable in particular as charging units for internal combustion engines.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A displacement machine for a compressible medium, comprising:

a fixed housing comprised of two housing portions and having at least one spiral-shaped feed chamber, the housing having an inlet leading into a radially outer portion of the spiral-shaped feed chamber and an outlet arranged at a radially inner portion of the spiral-shaped feed chamber, each said housing portion being provided with a bearing receptacle sized to project into the feed chamber;

a displacement body associated to the feed chamber and including a carrier disc and helical blades extending out from both sides of the carrier disc;

a drive shaft provided with an eccentric disc and rotatably supported in the housing on both sides of the eccentric disc by a first bearing and a second bearing, respectively, which are supported by the bearing receptacles, respectively, said drive shaft sized to extend on a drive side through a wall of the housing and having a drive-side end, said first and second bearings having an axial extent parallel to an axis of rotation of the drive shaft, and being defined in relation to the axial extent by centers which lie in a plane within the feed chamber, said plane being perpendicular to the axis of rotation of the drive shaft;

a bearing unit supporting the displacement body on the eccentric disc;

first and second counterweights arranged on the drive shaft on both sides of the eccentric disc and respectively disposed immediately adiacent both sides of the eccentric disc and the first and second bearings, respectively; and a drive supported by the drive-side end of the drive shaft.

2. The displacement machine of claim 1, wherein each counterweight includes a massive part disposed at a distance to a rotation axis of the drive shaft, and a mounting part coupled with the drive shaft in fixed rotative engagement and connected to the massive part, said mounting part having in a direction of the rotation axis of the drive shaft an axial dimension which is smaller than an axial dimension of the massive part.

3. The displacement machine of claim 2, wherein the axial dimension of the massive part is sized to overlap, at least in part, with both sides of a hub of the carrier disc and the bearing receptacle.

4. The displacement machine of claim 1, further comprising a support part extending from the housing in a direction of a length axis of the drive shaft and being traversed by the drive shaft, and a third bearing seated on the drive shaft for support in the support part.

5. The displacement machine of claim 4, further comprising means for establishing ambient pressure on both sides of the third bearing, wherein the third bearing is greased.

6. The displacement machine of claim 1, wherein each counterweight has a T-shaped configuration.

7. The displacement machine of claim 6, further comprising a through-opening is provided in the support portion, said through-opening connecting a space on one side of the third bearing with an environment of the displacement machine.

8. The displacement machine of claim 1, wherein the second bearing is greased and the bearing receptacle of the second bearing comprises a connecting line forming a connection between the feed chamber and the second bearing to establish an equal pressure on both sides of the second bearing.

9. The displacement machine of claim 1, further comprising a labyrinth seal arranged between the drive shaft and the housing in a region about the drive shaft extending through the housing, said labyrinth seal being formed by at least two throttles arranged in succession along a length of the drive shaft, wherein a space between the two throttles leads into a connecting line connected with the inlet of the displacement machine.

10. The displacement machine of claim 1, further comprising a hub bearing for support of the eccentric disc, wherein the first bearing and the hub bearing are lubricated with a liquid lubricant.

* * * * *